US007424961B2

(12) United States Patent
Grenier

(10) Patent No.: US 7,424,961 B2
(45) Date of Patent: Sep. 16, 2008

(54) TESTER FOR COSMETIC LIQUID SUCH AS PERFUME

(76) Inventor: Jean Grenier, 7 rue Mèdèric, Clichy (FR) 92110

( * ) Notice: Subject to any disclaimer, the term of this patent is extended or adjusted under 35 U.S.C. 154(b) by 0 days.

(21) Appl. No.: 11/313,141

(22) Filed: Dec. 19, 2005

(65) Prior Publication Data

US 2007/0138210 A1 Jun. 21, 2007

(51) Int. Cl.
*B65D 88/54* (2006.01)

(52) U.S. Cl. ..... 222/321.8; 222/182; 222/181.3

(58) Field of Classification Search ..... 222/321.8, 222/182–183, 180, 181.3, 185.1, 325, 327
See application file for complete search history.

(56) References Cited

U.S. PATENT DOCUMENTS

| | | | | |
|---|---|---|---|---|
| 3,233,787 | A * | 2/1966 | Ross | 222/179 |
| 6,405,906 | B1 * | 6/2002 | de Laforcade | 222/321.8 |
| 2006/0138175 | A1 * | 6/2006 | Germain | 222/321.8 |

* cited by examiner

*Primary Examiner*—Frederick C. Nicolas
(74) *Attorney, Agent, or Firm*—Polsinelli Shalton Flanigan Suelthaus PC

(57) ABSTRACT

The present invention relates to a tester or cosmetic liquid dispensing apparatus. More specifically, the tester includes a support, a holder for holding a bottle of cosmetic liquid, and controller for actuating a valve. The valve pumps liquid cosmetic such as perfume or toilet water ("eau de toilette") from the tester. The tester may be used with bottles of perfume of different sizes and the controller can be easily removed and replaced when a new perfume bottle is used.

9 Claims, 3 Drawing Sheets

TESTER FOR COSMETIC LIQUID SUCH AS PERFUME

FIELD OF INVENTION

The invention generally relates to a tester or liquid dispensing apparatus and in particular, the invention relates to a cosmetic liquid such as perfume or toilet water ("eau de toilette") wherein the cosmetic is pumped from a bottle by a valve, said tester comprising a support and carried by a holding means for holding the bottle and control means for actuating the valve.

DESCRIPTION OF THE RELATED ART

U.S. Pat. No. 5,829,642 describes such a dispenser for testing spray cosmetic. The bottle containing the perfume is provided with a depressive valve and is placed behind the support between a fixed wall and a movable plate. The movable plate is actuated by hand and presses the valve against the fixed wall so that the liquid is sprayed on the hand of the user. But this dispenser can be used only with bottles having a determined height.

U.S. Pat. No. 4,838,456 describes a dispenser apparatus for a spray contained in an aerosol container. It cannot be used with a bottle.

SUMMARY OF INVENTION

According to the present invention, the dispensing apparatus comprises a valve which is placed above and separated from the bottle. Said valve has a capillary which is introduced inside the bottle and a dispenser pipe which is connected to the valve and which has an aperture in front of the support.

The dispensing apparatus comprises further control means being activated by the hand and acting on the valve such that said valve pumps the cosmetics and projects it into the dispenser pipe such that it drips drop by drop from the aperture of the dispenser pipe.

The valve being separated from the bottle makes it is possible to use the support of the dispensing apparatus with different types of bottles.

The foregoing and other objects, features and advantages will be apparent from the following description of the preferred embodiment of the invention as illustrated in the accompanying drawings.

DESCRIPTION OF THE PREFERRED EMBODIMENT

Figure 1:
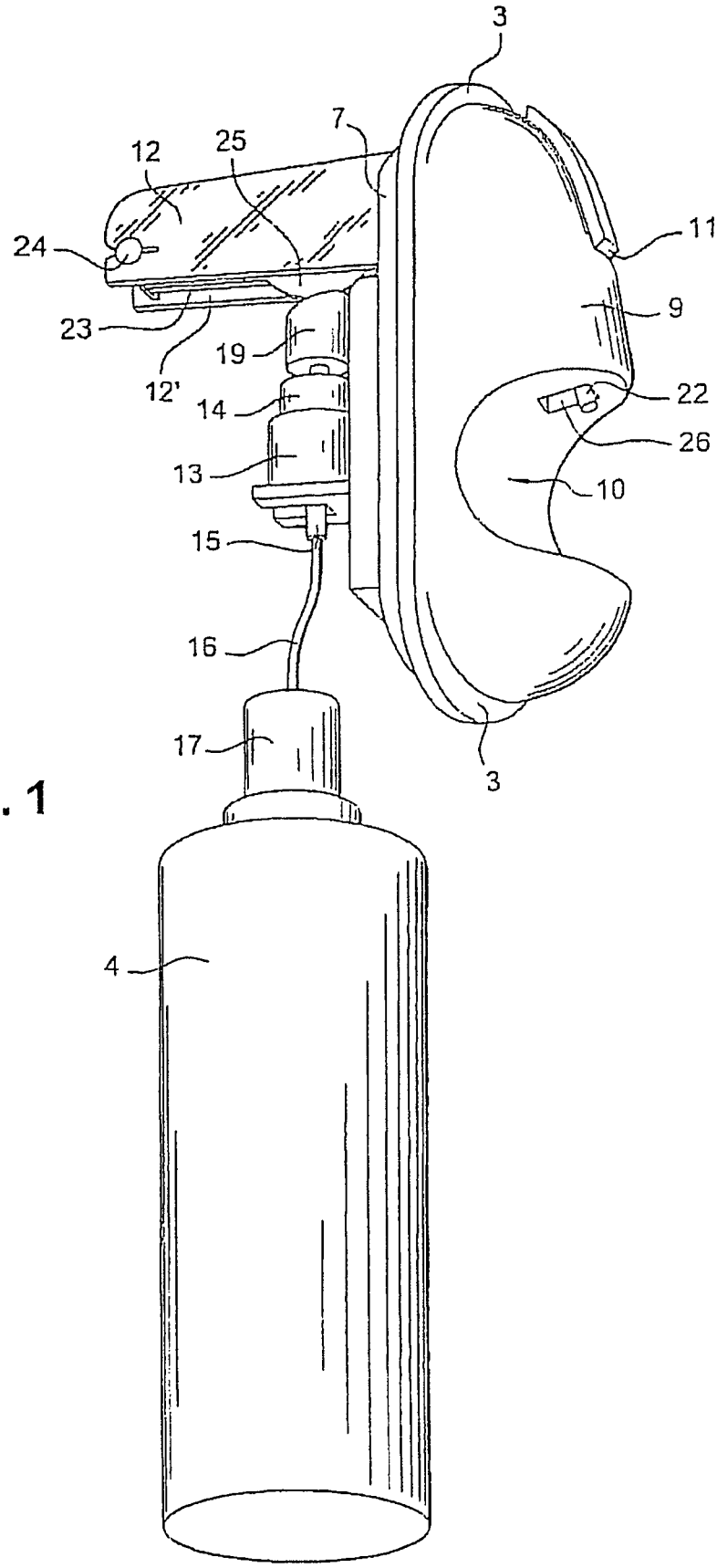
FIG. 1 is a perspective view of the dispensing apparatus of the invention without the support.
Figure 2:
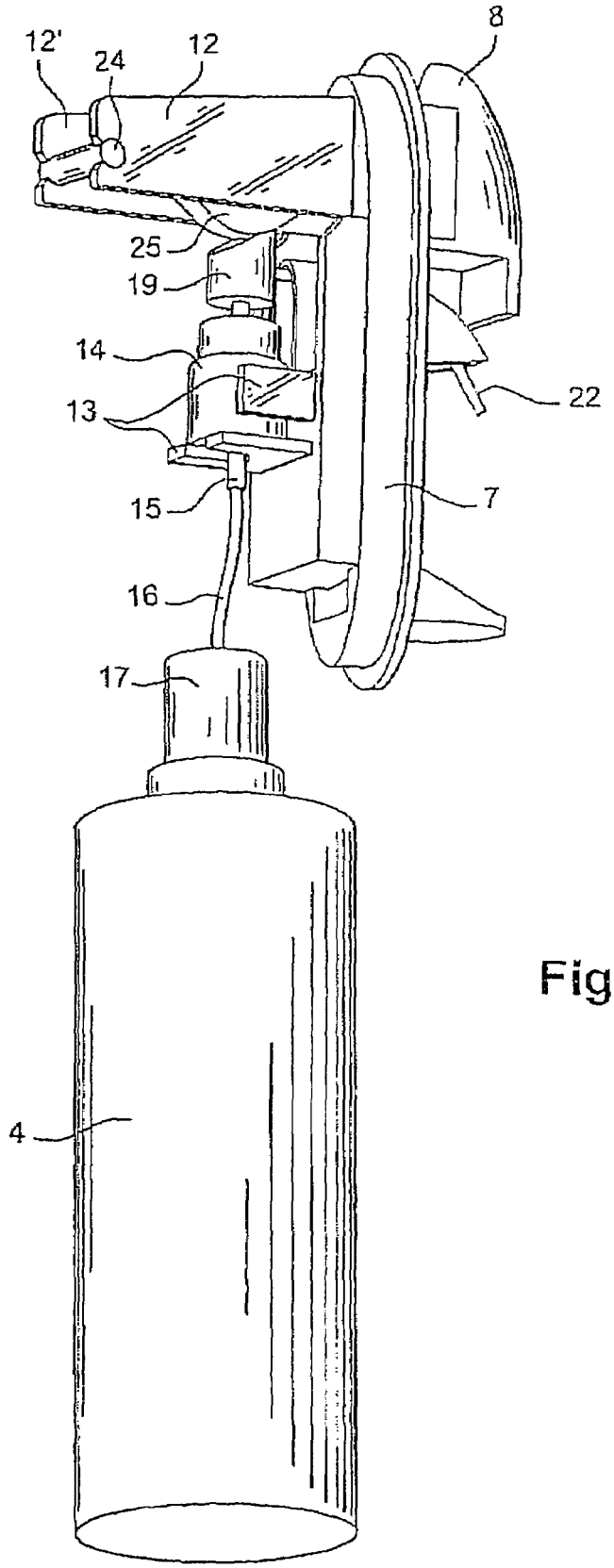
FIG. 2 is another perspective means without support and without the cover of the control means.
Figure 3:
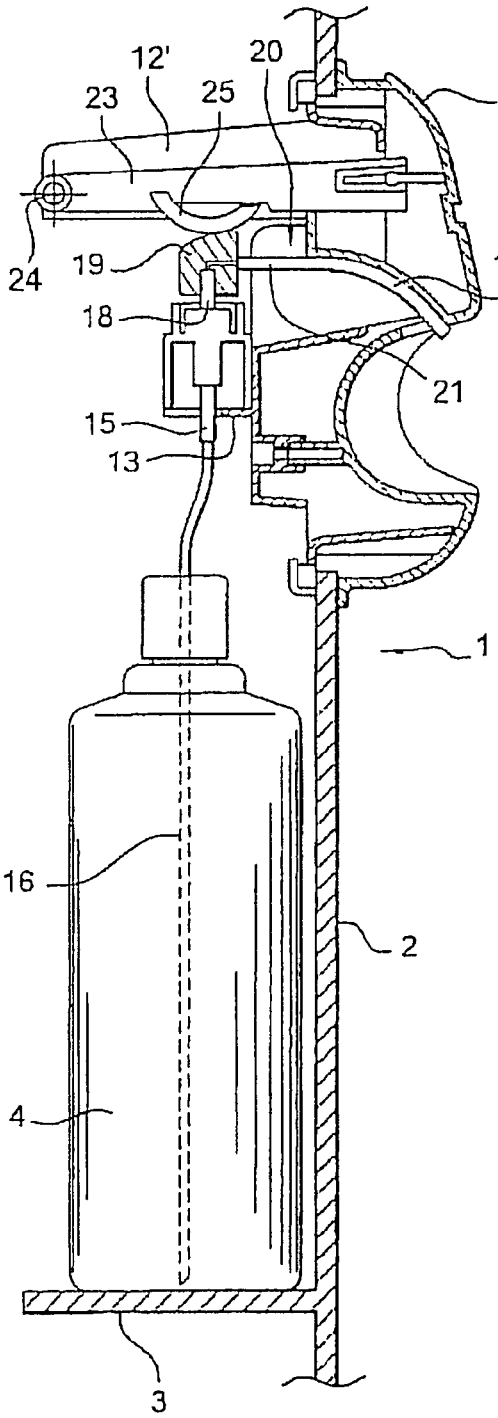
FIG. 3 is a section view taken along the line 3-3 of FIG. 1 with the support.

In FIGS. 1, 2, and 3 a dispensing apparatus 1 according to the invention is shown. Apparatus 1 includes a support 2 with holding means 3 for setting a bottle of perfume 4 and control means 5. Control means 5 comprises a vertical plate 7 with a button 8 which is guided in order to be moved vertically with a finger. This plate 7 is covered on one side by a cover 9 having a recess 10 and an opening 11 for placing the button 8. Plate 7 comprises on the other side, horizontal arms 12, 12' and a casing 13 for a valve 14.

Valve 14 includes an input 15 connected to a capillary 16 substantially vertical which is introduced in the bottle 4 through a cap 17 covering the bottle 4.

Valve 14 comprises further a vertical output 18 covered by a cap 19 connecting the output 18 to a nozzle 20 having a first horizontal portion 21 and a second portion 22 which is curved and inclined downwards.

The button 8 is fixed at one end of a horizontal leg 23, the second end of which being provided with an axis 24 perpendicular to the leg 23. Said axis 23 is horizontal and supported by the ends of the arms 11, 11'. Leg 23 comprises in its middle part a bulge 25 which presses on cap 19. Control means 5 with the valve 14 are assembled in one piece which is clipsed into an opening of the support 2.

Nozzle 20 is lodged into the control means 5 and its end emerges through an opening 26 in the recess 10 of the cover 9.

The operation of the dispensing apparatus is the following.

The user will press with his finger on the button 8 so that it will move downwards. The end of the leg 23 opposed to the axis 24 is then moved downwards turning around the axis 24.

The bulge 25 which is in contact with cap 19 presses this cap 19 and the fluid contained in the bottle 4 is pumped by the valve 14. Said fluid is projected into the nozzle 20 and drips drop by drop from the end of the nozzle 20 thereby avoiding any risk for the user to get fluid projected on his face. The user will put some part of his hand inside the recess 10 or some special paper to get some drop of perfume.

When the dispensing apparatus would be used for another perfume, control means 5 are taken away from the support 2 and a new control means 5 including the valve 14 with its capillary 16 is clipsed in the support 2.

Then a bottle 4 containing the new perfume is put in place behind the support 2. Capillary 16 is then introduced inside the bottle 4 through the cap 17 covering the bottle 4.

With this invention, bottles of different sizes and heights can be used without problem.

If something is broken in the control means 5, it is very easy to change the whole block, but of course the same support 2 can be used again.

When the bottle is empty, it is possible to replace it by a new bottle and then it is not necessary if it is the same perfume to remove the control means.

Figure 4A:
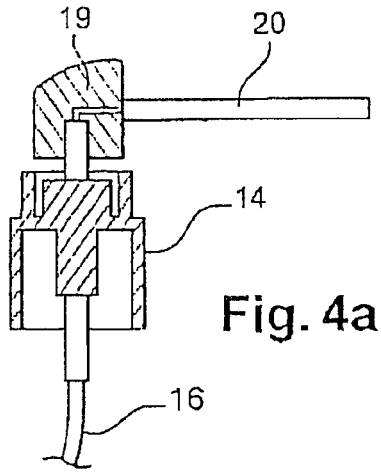
FIGS. 4*a* and 4*b* represent variants of the nozzle of the valve.
Figure 4B:
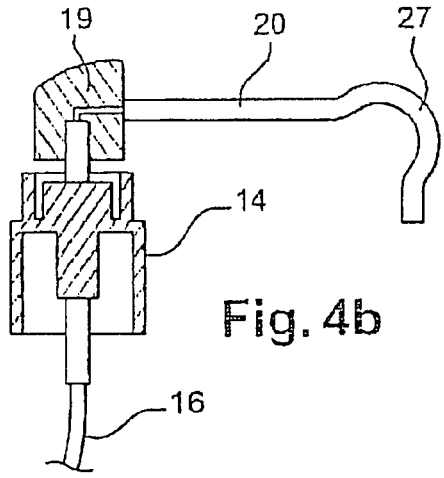

FIGS. 4*a* and 4*b* show two variants of the nozzle wherein the nozzle 20 is in a straight line or terminated by a portion 27 having a hook form.

With these types of nozzles the control means 5 has to be slightly modified so that the opening 26 in the recess 10 is at the same level as the nozzle 10.

The invention has been described with reference to the preferred embodiment. However, many variations are possible within the scope of the invention, in particular the cosmetic could be also aqueous gel or oleic gel. By changing the pump and its capillary, liquid soap could be used.

What is claimed is:

1. A tester for a cosmetic liquid, comprising:

a support;

a bottle containing the cosmetic liquid;

holding means holding said bottle;

a valve for pumping the cosmetic liquid from the bottle, said valve being held above and separated from the bottle and said valve having a capillary introduced inside the bottle;

a nozzle connected to said valve, said nozzle having an opening in front of the support; and control means for actuating the valve, said control means being carried by the support and said control means being activated manually for actuating the valve so that said valve pumps the cosmetic liquid into the nozzle, said control means comprising a button movable downwards, and a substantially horizontal leg pivoting at one end and actuated at the other end by said button so that said valve is actuated by an intermediate part of said leg;

wherein:

said valve and said nozzle are carried by the control means;

said valve has an axis of actuation, said valve being mounted with said axis of actuation vertical;

said nozzle comprises a first part extending horizontally from said valve, said first part being followed by a second part which is directed downwards; and said valve and said nozzle are adapted to cause the cosmetic liquid to drip drop by drop from the end of said nozzle when said valve is actuated.

2. A tester for a cosmetic liquid, comprising:

a support; holding means for holding a bottle containing the cosmetic liquid, said holding means being carried by the support;

a valve for pumping the cosmetic liquid from the bottle, said valve being held above and separated from the bottle and said valve having a capillary adapted to be introduced inside the bottle;

a nozzle connected to said valve, said nozzle having an opening in front of the support; and control means for actuating the valve, said control means being adapted to be activated manually for actuating the valve so that said valve pumps the cosmetic liquid into the nozzle;

wherein:

said valve and said nozzle are carried by the control means;

said valve has an axis of actuation, said valve being mounted with said axis of actuation vertical and said nozzle extending horizontally from said valve; and wherein the control means comprises;

a button movable downwards; and a substantially horizontal leg pivoting at one end and actuated at the other end by said button so that said valve is actuated by an intermediate part of said leg.

3. The tester of claim 2, wherein said nozzle comprises a first part extending horizontally from said valve, said first part being followed by a second part which is directed downwards.

4. The tester of claim 2, wherein said valve and said nozzle are adapted to cause the cosmetic liquid to drip drop by drop from the end of said nozzle when said valve is actuated.

5. The tester of claim 2, comprising a bottle containing the cosmetic liquid, the bottle being held by said holding means and said capillary being introduced inside the bottle.

6. A tester for a cosmetic liquid, comprising:

a support;

holding means for holding a bottle containing the cosmetic liquid, said holding means being carried by the support; and a valve for pumping the cosmetic liquid from the bottle, said valve being held above and separated from the bottle and said valve having a capillary adapted to be introduced inside the bottle;

a nozzle connected to said valve, said nozzle having an opening in front of the support; and control means for actuating the valve, said control means being carried by the support and said control means being activated manually for actuating the valve so that said valve pumps the cosmetic liquid into the nozzle;

wherein:

said valve and said nozzle are carried by said control means;

said valve has an axis of actuation, said valve being mounted with said axis of actuation vertical and said nozzle extending horizontally from said valve; and wherein the control means comprises:

a button movable downwards; and a substantially horizontal leg pivoting at one end and actuated at the other end by said button so that said valve is actuated by an intermediate part of said leg.

7. The tester of claim 6, wherein the nozzle comprises a first part extending horizontally from said valve, said first part being followed by a second part which is directed downwards.

8. The tester of claim 6, wherein said valve and said nozzle are adapted to cause the cosmetic liquid to drip drop by drop from the end of said nozzle when said valve is actuated.

9. The tester of claim 6, comprising a bottle containing the cosmetic liquid, the bottle being held by said holding means and said capillary being introduced inside the bottle.

* * * * *